US005379101A

United States Patent [19]

Takahashi et al.

[11] Patent Number: 5,379,101

[45] Date of Patent: Jan. 3, 1995

[54] IMAGE FORMING APPARATUS IN WHICH UNITS CONNECTED TOGETHER OCCUPY A RELATIVELY SMALL AREA

[75] Inventors: Tomohiko Takahashi; Takashi Matsuoka, both of Yokohama; Yoshitsugu Nakatomi, Yokosuka; Koji Kagaya, Kawasaki, all of Japan

[73] Assignee: Kabushiki Kaisha Toshiba, Kawasaki, Japan

[21] Appl. No.: 937,400

[22] Filed: Aug. 31, 1992

[30] Foreign Application Priority Data

Sep. 5, 1991 [JP] Japan ..... 3-226075

[51] Int. Cl.[6] ..... G03G 21/00

[52] U.S. Cl. ..... 355/309; 271/9; 355/200; 355/321

[58] Field of Search ..... 355/309, 322, 200, 308, 355/321, 323; 271/9

[56] References Cited

U.S. PATENT DOCUMENTS 5,049,946 9/1991 Harada ..... 355/309
5,102,112 4/1992 Takahashi ..... 271/9

FOREIGN PATENT DOCUMENTS 63-154547 6/1988 Japan ..... 271/9
2-13537 1/1990 Japan ..... 271/9

*Primary Examiner*—A. T. Grimley
*Assistant Examiner*—Shuk Y. Lee
*Attorney, Agent, or Firm*—Foley & Lardner

[57] ABSTRACT

A compact image forming apparatus which occupies a small floor area even though it has optional units connected to it. The apparatus includes an image forming device, a paper-reversing device attached to a side of the image forming device, a paper-feeding unit, a large-capacity paper-feeding unit, and a large-capacity storage unit. The image forming device and the paper-reversing device are mounted on the paper-feeding unit, which, in turn, is mounted on the large-capacity paper-feeding unit. The large-capacity paper-feeding unit is mounted on the large-capacity storage unit. The total bottom area of the image forming device and the paper-reversing section attached to the side of the image forming device is substantially equal to the top area of the paper-feeding unit, that of the large-capacity paper-feeding unit, and that of said large-capacity storage unit.

15 Claims, 14 Drawing Sheets

IMAGE FORMING APPARATUS IN WHICH UNITS CONNECTED TOGETHER OCCUPY A RELATIVELY SMALL AREA

BACKGROUND OF THE INVENTION

1. Field of the Invention

This invention relates to an image forming apparatus comprising an image forming unit, such as a laser printer, for forming images on transfer materials, and an optional unit, such as a large-capacity paper feeding device integrally connected to the image forming unit.

2. Description of the Related Art

Hitherto, an image forming apparatus, such as a laser printer, was connected to optional units such as a paper feeding unit and a paper discharging unit, or to a paper inverting unit and a paper transfer unit. The optional units are placed in the same plane as the image forming apparatus, for example on the same table. Hence, a resultant system comprising the image forming apparatus and the optional units occupies a large area inevitably.

SUMMARY OF THE INVENTION

The object of the invention is to provide an image forming apparatus comprising an image forming unit and other units which are connected to the image forming unit and to one another such that the apparatus, as a whole, occupies but a relatively small area.

The objects of the present invention are realized by arranging the total bottom area of a first unit and a second unit, which is detachably connected to the side of the first unit, to be substantially equal to each of the top areas and bottom areas of at least the third and fourth units. The third unit is located beneath the first and second units, and the fourth unit is located beneath the third unit. With this arrangement, the image forming apparatus occupies only a relatively small part of the whole area.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An embodiment of the present invention will now be described, with reference to the accompanying drawings.

Figure 1:
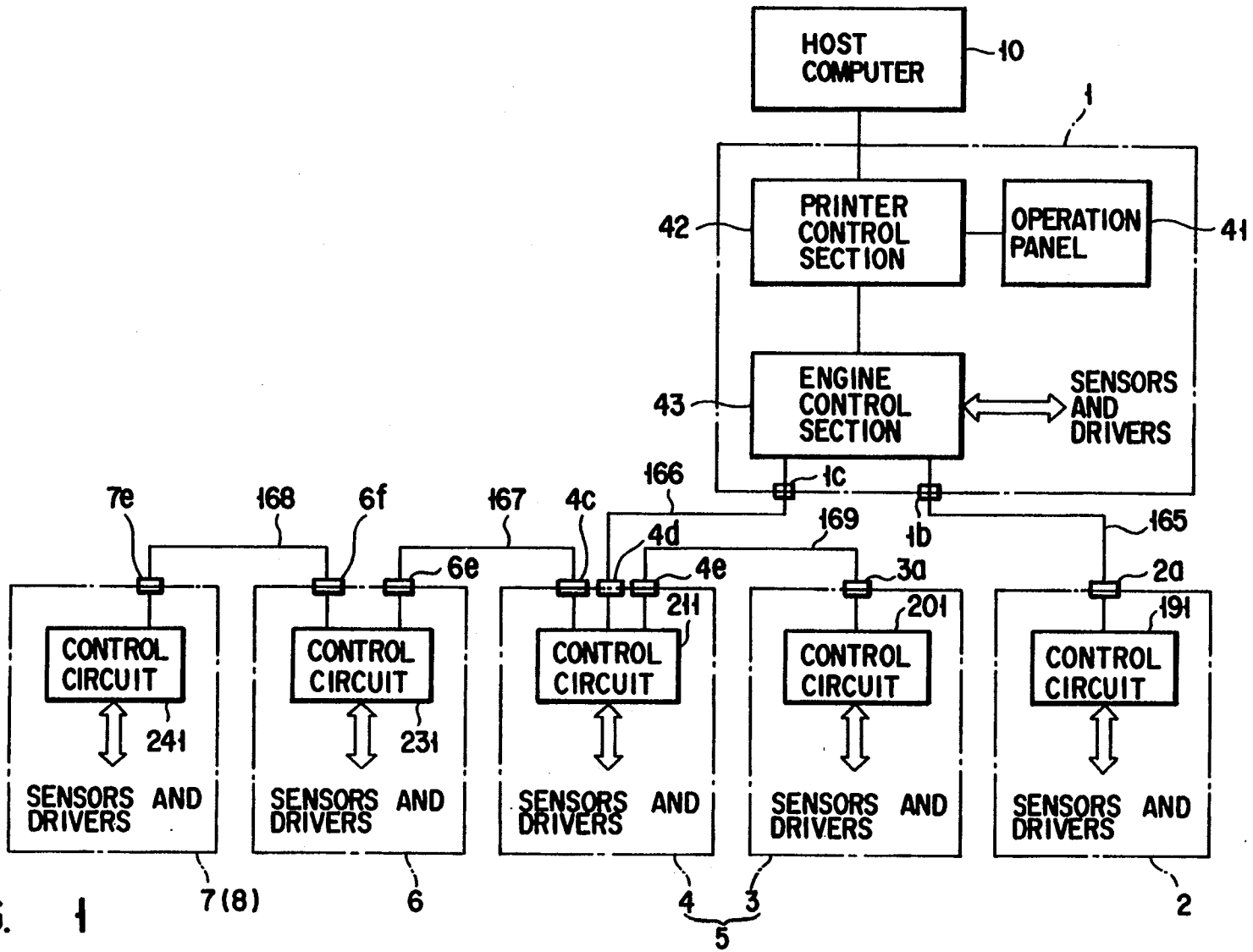
FIG. 1 is a block diagram showing an image forming system for an embodiment of the invention, which comprising a laser printer and optional units.

FIG. 1 is a block diagram showing a image forming system according to the invention. The system comprises a laser printer 1 and several optional devices. The laser printer 1 is an image forming device designed to receive data from a host computer 10 (i.e., an external device) and print on a sheet of paper an image represented by the the data. The optional devices are: a paper feeder (MPF) 2, an automatic document duplexer (ADD) 5, a large-capacity feeder (LCF) 6, and a large-capacity stacker (LCS) 7. These optional devices are connected to the laser printer 1, some directly thereto, and the others indirectly thereto. The automatic document duplexer 5 comprises a paper-reversing section 3 and a paper-feeding section 4.

Figure 2:
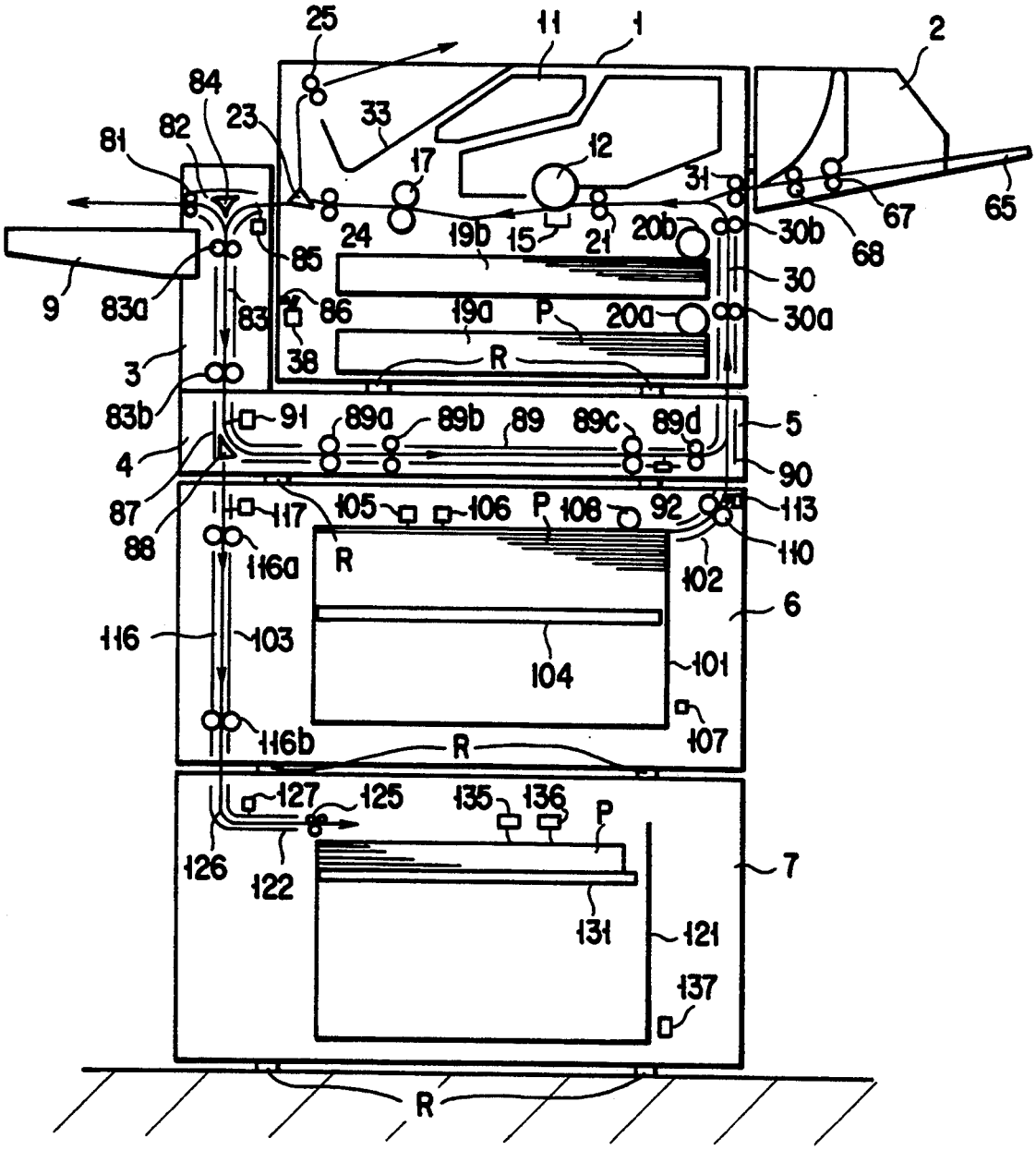
FIG. 2 is a front view of the system, schematically showing the internal structure of the apparatus.

As is shown in FIG. 2, the paper feeder 2 is connected to the right side of the laser printer 1. The paper-reversing section 3 of the automatic document duplexer 5 is connected to the left side of the laser printer 1. The paper-feeding section 4 of the automatic document duplexer 5 is connected to the bottom of the laser printer 1. The large-capacity feeder 6 is connected to the bottom of the paper-feeding section 4. The large-capacity stacker 7 is connected to the bottom of the large-capacity feeder 6. The total bottom area of the laser printer 1 and the paper-reversing section 3 is substantially equal to the top areas and bottom area of the paper-feeding section 4, which are the same; to the top areas and bottom area of the large-capacity feeder 6, which are the same; and to the top area and bottom area of the large-capacity stacker 7, which are the same. Hence, the image forming system, constituted by the components 1, 2, 3, 4, 6 and 7, which are arranged as is shown in FIG. 2, occupies but a relatively small floor area which is substantially equal to the bottom area of the large-capacity stacker 7. Each of the components 1, 2, 3, 4, 6 and 7 has two parallel rails R on the bottom. Due to these rails R, the component is correctly positioned when mounted on the immediately lower component. As a result, any port made in the bottom of the component is automatically aligned with the port made in the top of the lower component when the former is mounted on the latter.

A paper tray 9 is connected to the paper-reversing section 3, for receiving the paper sheets fed from the laser printer 1 and also the paper sheets fed from the automatic document duplexer 5.

Figure 3:
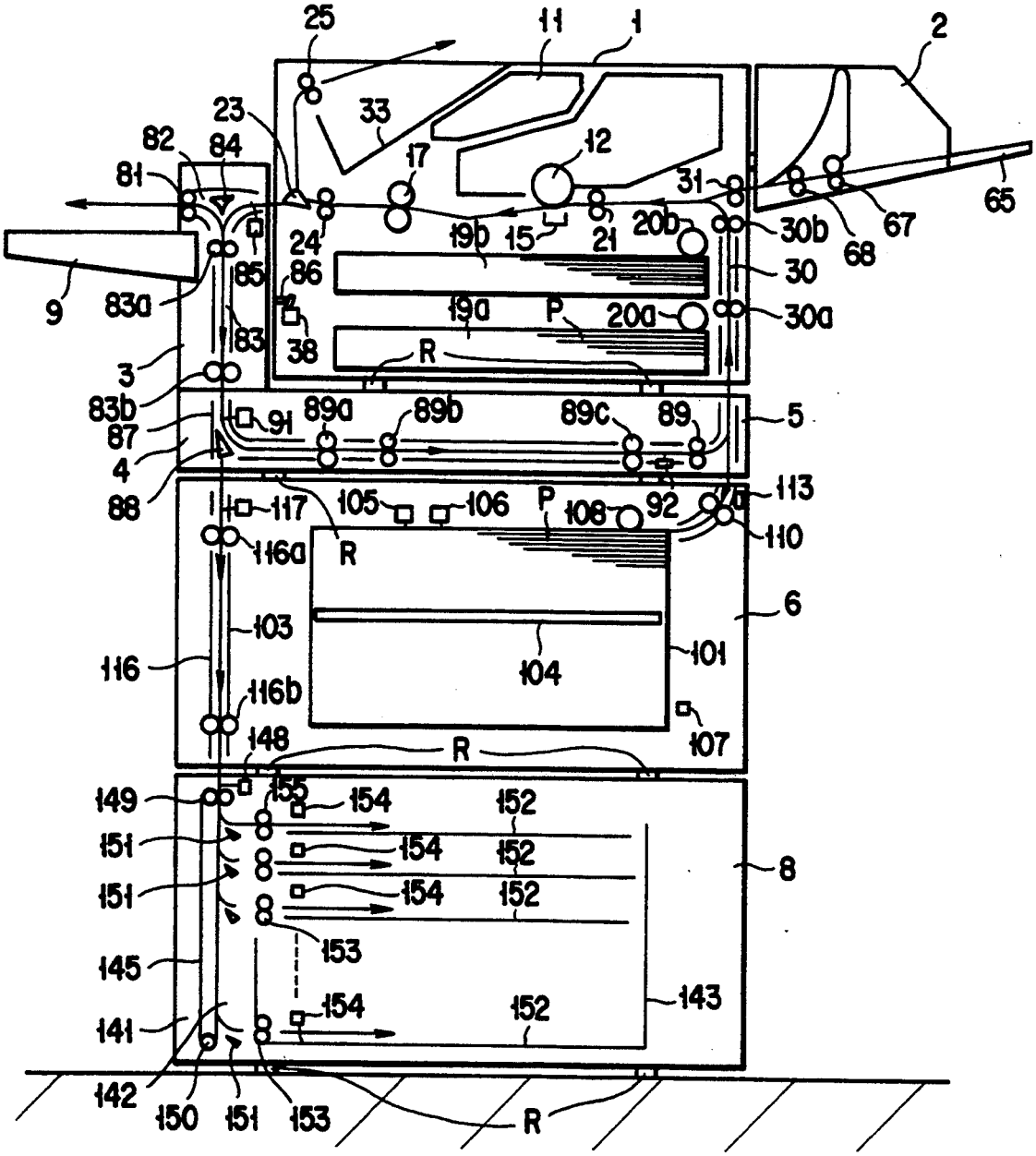
FIG. 3 is a cross-sectional view showing the structure of the image forming system.

As is shown in FIG. 3, the large-capacity stacker 7 can be replaced by a sorter 8, or mail box stacker (MBS).

The port of the paper-feeding section, which is the lower part of the paper-reversing section 3, can be connected to the port of a connecting section (not shown), while aligned with three paper-feeding sections mounted on the tops of the large-capacity feeder 6, the large-capacity stacker 7 and the sorter 8, respectively. Hence, the large-capacity feeder 6, the large-capacity stacker 7, and the sorter 8 can operate independently of one another, if the autocratic document duplexer 5 is mounted on each of these components and the laser printer 1 is mounted on the paper-feeding section 4 of the automatic document duplexer 5.

Six pairs of parallel rails R are attached to the lower surfaces of the laser printer 1, the paper-feeding section 4, the large-capacity feeder 6, the large-capacity stacker 7 and the sorter 8, respectively. The rails R of any of these components, except for the stacker 7 and the sorter 8, not only bear the weight of the component, but also serve to position the component correctly when the component is placed on the immediately lower component.

Figure 4:
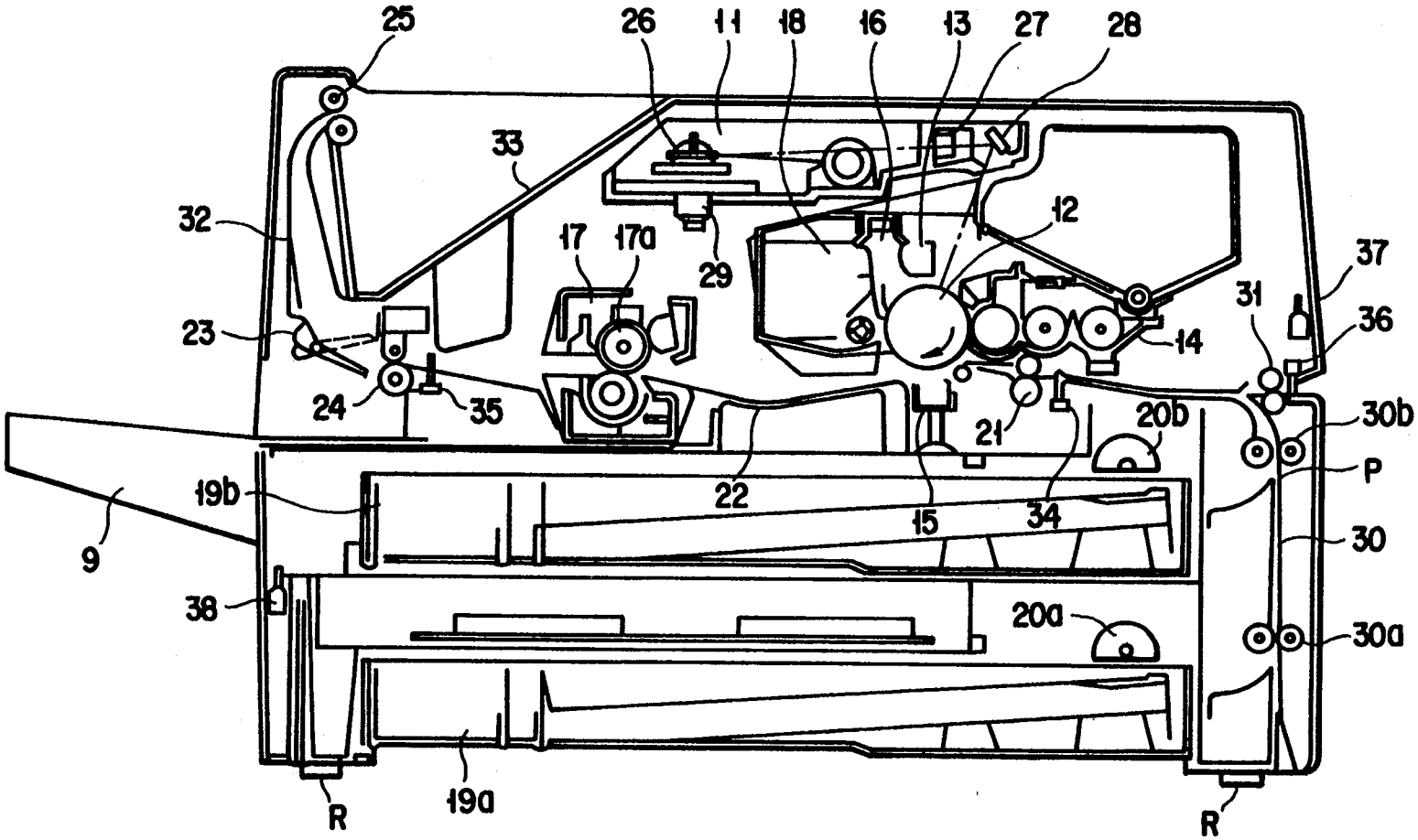
FIG. 4 is a cross-sectional view of the laser printer shown in FIG. 1.

FIG. 4 shows the laser printer 1 in detail. Arranged within the housing of the printer 1 are a laser optical system 11, a photosensitive drum 12, an electric charger 13, a developing device 14, an image transfer device 15, a pre-exposure device 16, a fixing device 17, and a cleaning device 18—together constituting a paper-processing system. The electric charger 13 is a Scoroton, and the image transfer device 15 is a Corotron. Also arranged within the housing are paper cassettes **19*a* and 19*b*, paper-feeding rollers 20*a* and 20*b*, a pair of aligning rollers 21, a paper guide 22, a gate 23, a pair of paper-discharging rollers 24, and another pair of paper-discharging rollers 25**.

The laser optical system 11 comprises a semiconductor laser (not shown), a collimator lens (not shown), a polygon mirror 26, a f$\theta$ lens 27, a mirror 28 and a mirror motor 29. The laser emits a laser beam, and the collimator lens converts the laser beam to a parallel laser beam. The polygon mirror 26 is a rotary member and has an octahedral mirror section for reflecting the laser beam supplied from the lens, thereby applying the beam along a scanning line. The mirror motor 29 rotates the polygon mirror 26.

The laser printer 1 forms an image in the following way. Image data is supplied to the laser optical system 11 from an image from the image data supplied from the host computer 10 (i.e., an external device) or an image input device (not shown). Meanwhile, the photosensitive drum 12 is rotated in the direction of the arrow shown in FIG. 4, an the electric charger 13 electrically charges the surface of the drum 12. In accordance with the image data, the laser optical system 11 applies a laser beam onto the photosensitive drum.

More specifically, the polygon mirror 26 is driven by the mirror motor 26. The rotating mirror 26 reflects the laser beam emitted from the semiconductor, such that the beam repeatedly scans the surface of he drum 12 at a constant speed, from the left end of the drum 12 to the right end thereof. As a result, an electrostatic latent image corresponding to the image data is formed on the surface of the photosensitive drum 12. The electrostatic latent image is converted into a visible one, i.e., a toner image, as the developing device 14 applies toner onto the surface of the photosensitive drum 12.

In the meantime, the paper sheets P are fed, one by one, from the paper cassette **19*a* or 19*b* by means of the paper-feeding roller 20*a* or 20*b*. Each paper sheet P is guided to the aligning rollers 21 along a passage 30 as it fed forward by a pair of rollers 30*a* and another pair of rollers 30*b*. The aligning rollers 21, which are rotated by known means, feed the sheet P to the image transfer device 15 which is located right below the photosensitive drum 12**.

A paper sheet P can be supplied to the image transfer device 15 from the paper feeder 2, i.e., an optional device, which is connected to the right side of the laser printer 1. When necessary, the paper feeder 2 feeds a paper sheet P into the housing of the laser printer 1 through a slot made in the right side of the printer 1. A pair of paper-feeding rollers 31, located within the housing, just behind the slot, feed the sheet P to the aligning rollers 21. The aligning rollers 21 feed the sheet P to the image transfer device 15.

Also, a paper sheet P can be supplied to the image transfer device 15 from the other optional devices, i.e., the automatic document duplexer 5, the large-capacity feeder 6, the large-capacity stacker 6, and the sorter 8. Whenever necessary, a paper sheet P is fed from any of these optional devices to the aligning rollers 21 along the passage 30, and the aligning rollers 21 feed the sheet P to the image transfer device 15.

Any paper sheet P supplied to the image transfer device 15 is brought into contact with the surface of the photosensitive drum 12. The toner image formed on the drum 12 is thereby transferred onto the paper sheet P. The sheet P, now bearing the toner image, is moved from the fixing device 17 along the paper guide 22. The fixing device 17 has a heat roller **17*a* and another roller paired with the heat roller 17*a*. The heat roller 17*a* contains a heater lamp 17*b*, and is heated to a predetermined temperature monitored by a thermistor 17*c*. As the paper sheet P passes through the nip between the heat roller 17*a* and said other roller, the roller 17*a*** applies heat to the sheet P, thus melting the toner particles defining the toner image. As a result, the image is fixed on the paper sheet P.

The paper sheet P, now having the image fixed on it, is discharged onto a paper tray 9 through a gate 23 by means of the paper-discharging rollers 24, or into an upper passage 32 through the gate 23 to the paper-discharging rollers 25, which discharge the sheet P onto a paper tray 33.

After the toner image has been transferred from the drum 12 onto the paper sheet P, the cleaning device 18 removes the residual toner from the photosensitive drum 12. Thereafter, the pre-exposure device 16 erases the residual image from the photosensitive drum 12, so that another image may be formed on the surface of the drum 12.

The photosensitive drum 12, the electric charger 13, the developing device 14, the pre-exposure device 16, the fixing device 17, and the cleaning device 18 are combined, forming an electrophotographic process unit which is removably placed within the housing of the laser printer 1.

As is shown in FIG. 4, a switch 34 is located in front of the aligning rollers 21, for detecting the erroneous supply of a paper sheet P. A switch 35 is provided in front of the paper-discharging rollers 24, for detecting the erroneous discharging of a paper sheet P. Further, a paper-feeding detector 36 is arranged in front of the paper-feeding rollers 31, for detecting the passage of a paper sheet P which has been supplied by hand or by paper feeder 2. A switch 37 is located above the paper-feeding detector 36, for detecting the connection of the paper feeder 2 to the laser printer 1. Also, a switch 38 is secured on the left side of the paper cassettes 19*a* and 19*b*, for detecting the connection of the paper-reversing section 3 to the laser printer 1.

An engine control board and a printer control board are arranged between the paper cassettes 19*a* and 19*b*. Mounted on the engine control board is an engine control section 43 designed to control the electric components contained in the printer 1, thereby to accomplish an electrophotographic process. Mounded on the printer control board is a printer control section 42 designed to control the engine control section 43.

Figure 5:
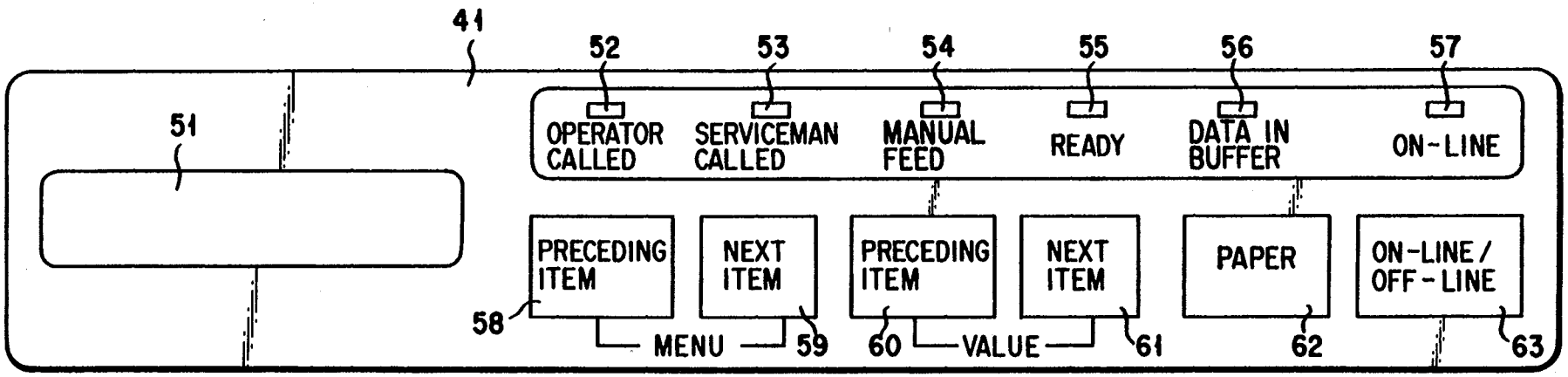
FIG. 5 is a plan view of the operation panel shown in FIG. 1.

An operation panel 41 is mounded atop the laser printer 1. As shown in FIG. 5, the panel 1 has a liquid-crystal display 51, LED displays 52 to 57, a preceding menu-item key 58, a next menu-item key 59, a preceding value key 60, a next value key 61, a paper eject key 62, and an on-line key 63. The liquid-crystal display 51 is designed to display the number of copies to make, the mode in which to operate the printer 1, and various instructions, messages, and the like. The on-line key 63 is operated to set the laser printer 1 in the on-line mode or the off-line mode.

The LED displays 52–57 each have an LED (light-emitting diode), which is turned on to indicate a specific condition in which the printer 1 is operating. More specifically, the LED of the display 52 is turned on to call for an operator; the LED of the display 53 is turned on to call for a serviceman; the LED of the display 54 is turned on to ask an operator to feed paper sheets by hand; the LED of the display 55 is turned on to indicate that the printer 1 is ready to work; the LED of the display 56 is turned when on image data is being supplied to the memory of the printer 1; and the LED of the display 57 is turned on to indicate that the printer 1 is in the on-line mode, or is connected to the host computer 10.

The liquid-crystal display 51 displays various menu items on its left half portion. The menu items are incremented every time the next menu-item key 59 is pushed, and are decremented every time the preceding menu-item key 58 is pushed. Hence, any menu item can be displayed cyclically on the display 51 by depressing the key 58 or 59.

The liquid-crystal display 51 displays on its right half portion the values For the menu items displayed on the left half portion. These values are incremented every time the next value key 61 is pushed, and are decremented every time the preceding value key 60 is pushed. Thus, the value for any menu item can be cyclically displayed on the display 51 by depressing the key 60 or 61.

One of the menu items is the designated paper source, i.e., the paper cassette 19*a*, the paper cassette 19*b*, the paper feeder 2, or the large-capacity feeder 6. Another of the menu items is the designated paper destination, i.e., the paper tray 9, the paper tray 33, the large-capacity stacker 7, or the sorter 8.

Therefore, an operator can select any operation he or she wants the laser printer 1 to perform, by pushing the preceding menu-item key 58, the next menu-item key 59, the preceding value key 60, and the next value key 61—all provided on the operation panel 41.

Figure 6:
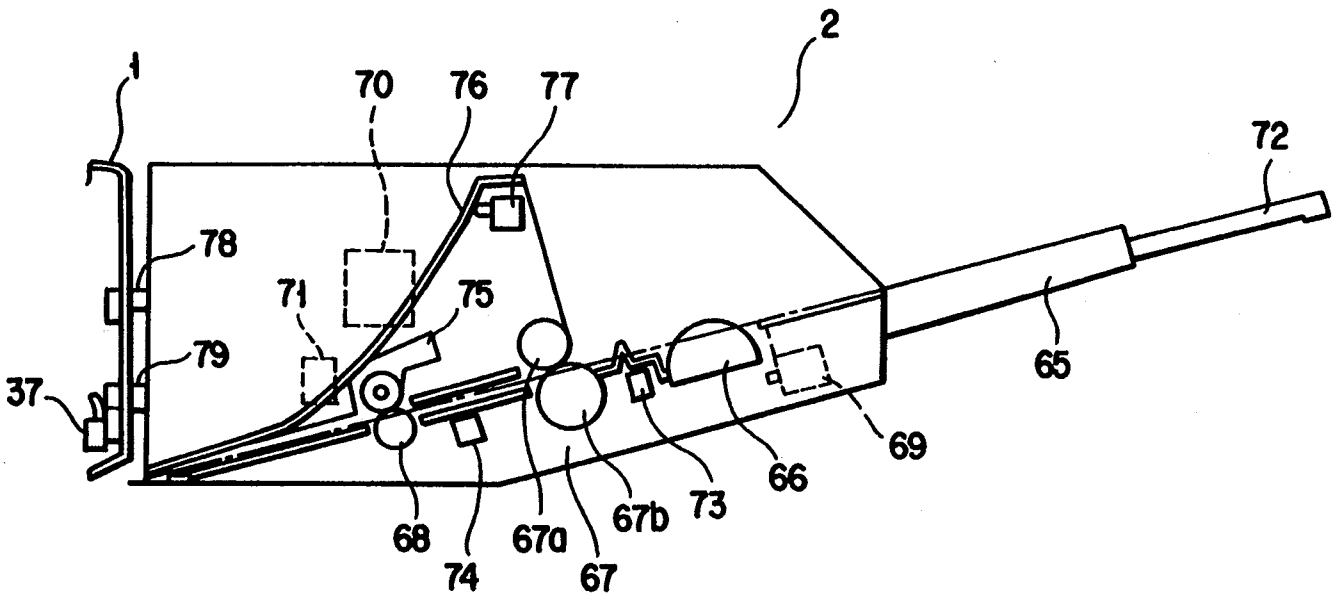
FIG. 6 is a cross-sectional view of the paper feeder shown FIG. 1.

FIG. 6 is a cross-sectional view of the paper feeder 2. As this figure shows, the paper feeder 2 comprises a paper tray 65, a pickup roller 66, a separating roller unit 67, a pair of aligning rollers 68, a paper-feeding solenoid 69, an electric motor 70, and a aligning solenoid 71. The pickup roller 66 rotates, feeding the paper sheets P placed on the tray 65, all to the separating roller unit 67.

The separating roller unit 67 comprises an upper roller 67*a* and a lower roller 67*b*. A torque limiter (not shown) exerts a predetermined load on the upper roller 67*a*. The lower roller 67*b* extends parallel to and put in contact with the upper roller 67*a*, and drives the upper roller 67*a*. The rollers 67*a* and 67*b* cooperate to separate a paper sheet P from the other sheets P supplied by the pickup roller 66, and to feed this sheet P to the aligning rollers 68. The rollers 68 first align the paper sheet P and then supply it into the laser printer 1 via the slot made in the right side of the printer 1. The sheet P is fed farther into the printer 1 by means of the paper-feeding rollers 31 which are located within the housing, just behind the slot.

The paper-feeding solenoid 69 transmits the drive force of the electric motor 70 to the pickup roller 66, thereby rotating the roller 66. The aligning solenoid 71 transmits the drive force of the motor 70 to the aligning rollers 68, thus rotating these rollers 68. The force of the electric motor 70 is also transmitted to the lower roller 67*b* of the separating roller unit 67, whereby roller 67*b* is driven.

As is shown in FIG. 6, a extension tray 72 is connected to the paper tray 65, so that these trays 65 and 72 support larger paper sheets which the tray 65 alone cannot hold. A paper-empty switch 73 is located between the pickup roller 66 and the roller unit 67, for detecting whether or not paper sheets are placed on the paper tray 65. An aligning switch 74 is arranged between the roller unit 67 and the aligning rollers 68, for detecting a paper sheet P passing from the unit 67 to the aligning rollers 68.

The paper feeder 2 has a cover 76 and a door switch 77 attached to the cover 76. The cover 76 can be opened, allowing access to the aligning rollers 68. Hence, a jamming paper sheet can be removed from the aligning rollers 68. The door switch 77 is turned on when the cover 76 is opened, and is turned off when the cover 76 is closed.

As also shown in FIG. 6, connector 78 and a projection 79 are provided on the left side of the paper feeder 2. The connector 78 connects the paper feeder 2 to the laser printer 1. When the feeder 2 is connected to the printer 1, the projection 79 abuts the switch 37 contained in the printer 1, whereby this switch 37 detects that the paper feeder 2 has been connected to the laser printer 1.

With reference to FIG. 2, the automatic document duplexer 5, which comprises the paper-reversing section 3 and the paper-feeding section 4, will now be described in detail.

The paper-reversing section 3 comprises a pair of paper-discharging rollers 81, a first paper passage 82 for guiding a paper sheet P to the rollers 81 from the gate 23 of the laser printer 1, a second paper passage 83 for guiding a paper sheet P downward to the paper-feeding section 4, said sheet P having been discharged through the gate 23 or supplied by the paper-discharging rollers 81 rotating in the reverse direction, and a gate 84 for guiding a paper sheet P into either the first passage 82 or the second passage 83.

In operation, the paper sheet P discharged through the gate 23 of the laser printer 1 is guided through the first passage to the gate 84. The gate 84 guides the sheet P to the paper-discharging rollers 81 or into the second paper passage 83. The sheet P guided to the rollers 81 is discharged onto the paper tray 9 by the paper-discharging rollers 81 rotating in the forward direction, or is guided toward the tray 9 for a distance equal to its length by the rollers 81 rotating in the forward direction and then back to the gate 84 by the rollers 81 rotating in the reverse direction. The paper sheet P, thus supplied to the gate 84, is guided into the second passage 83 and fed downward into the paper-feeding section 4.

A sensor 85 is located at the entrance to the first paper passage 82, for detecting the supply of a paper sheet P from the laser printer 1 into the first paper passage 82 of the paper-reversing section 3.

The second paper passage 83 is constituted by a pair of paper-feeding rollers 83*a* and another pair of paper-feeding rollers 83*b*.

A projection 86 protrudes from the right side of the paper-reversing section 3. When the section 3 is connected to the laser printer 1, the projection 86 pushes the switch 38 sectored within the printer 1. As a result, the switch 38 detects that the paper-reversing section 3 has just been connected to the laser printer 1.

As shown in FIG. 2, the paper-feeding section 4 comprises three paper passages 87, 89 and 90 and one gate 88. The first paper passage 87 guides a paper sheet P downwards from the paper-reversing section 3 into the large-capacity feeder 6. The second paper passage 89 branches from the fist passage 87, for guiding a paper sheet P horizontally to the third paper passage 90. The third paper passage 90 is connected to the second passage 89, for guiding upwards a paper sheet P from the second passage 89 or from the large-capacity feeder 6 into the laser printer 1. The gate 88 guides a sheet P supplied from the paper-reversing section 3 into the large-capacity feeder 6 through the first passage 87 or into the second passage 79.

In operation, the paper sheet P fed from the paper-reversing section 3 is guided through the first passage 87 to the gate 88. The gate 88 guides the sheet P into either the large-capacity feeder 6 or the second paper passage 89. The sheet P guided into the second passage 89 is fed into the first paper passage 30 of the laser printer 1. The sheet P supplied from the large-capacity feeder 6 is fed into the first paper passage 30 of the printer 1 through the third paper passage 90 of the paper-feeding section 3.

A sensor 91 is located in the vicinity of the entrance to the first paper passage 87 of the paper-feeding section 4. The sensor 91 detects the paper sheet P being supplied from the paper-reversing section 3 and passing through the first passage 87 of the paper-feeding section 4.

The second paper passage 89 comprises three pairs of paper-feeding rollers, 89*a*, 89*b* and 89*c*, and one pair of aligning rollers 89*d*. A sensor 92 is located between the pair of paper-feeding rollers 89*c* and the pair of aligning rollers 89*d*. The sensor 92 detects the sheet P which is being fed through the second paper passage 89.

It will now be explained how the image forming system shown in FIG. 2 prints images on both sides of a paper sheet P, with reference to FIGS. 7 to 10.

Figure 7:
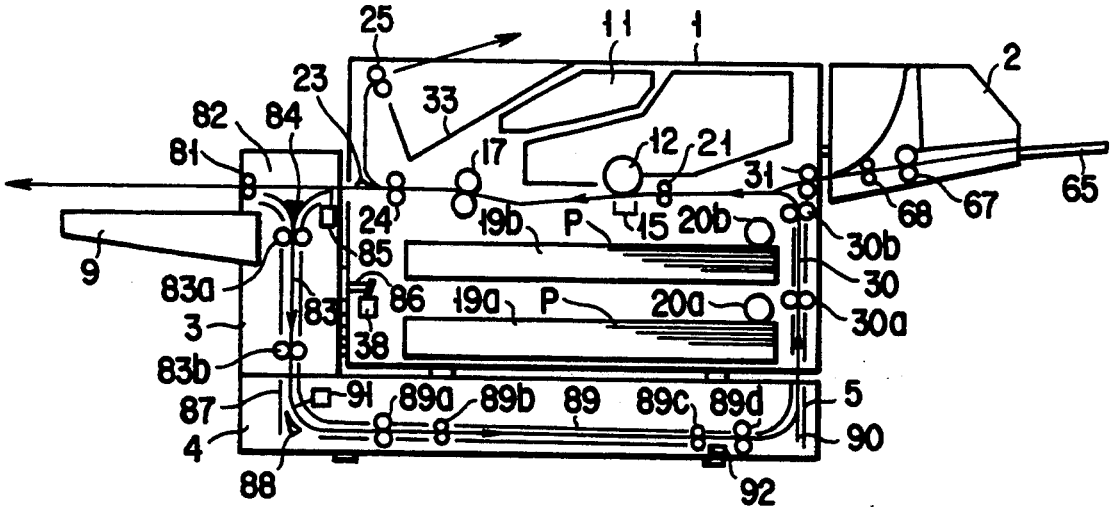
FIG. 7 is another cross-sectional view of the laser printer shown in FIG. 1.
Figure 8:
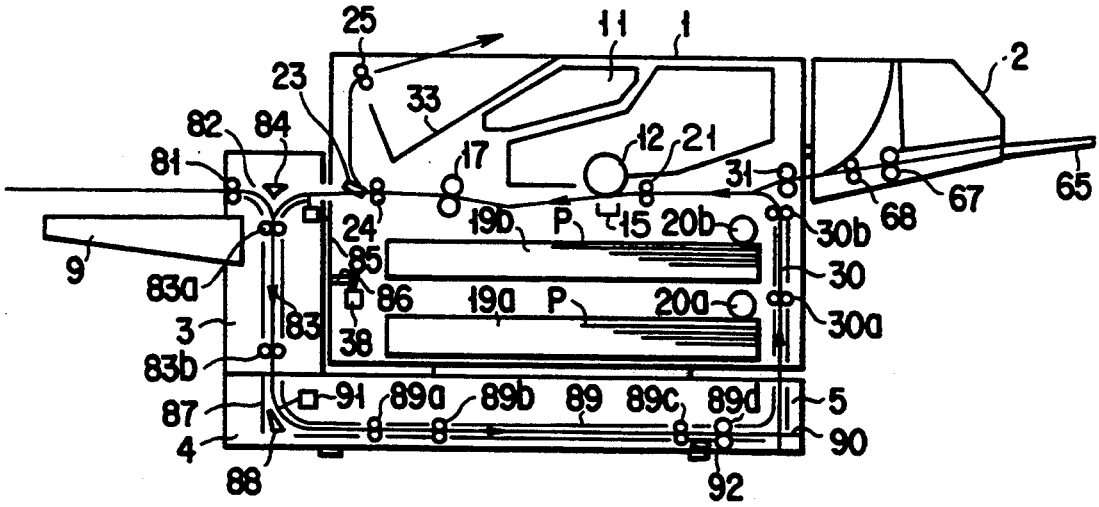
FIG. 8 is still another cross-sectional view of the laser printer shown in FIG. 1.

When a paper sheet P with an image printed on one of its sides is discharged from the laser printer 1 into the first paper passage 82 of the paper-reversing section 3, the sensor 85 is turned on, thus detecting that the sheet P has just been fed into the first paper passage 82. Then, the gate 84 is rotated downwardly, whereby the sheet P passes over the gate 84. As a result, the sheet P is discharged onto the paper tray 9 by the paper-discharging rollers 81 which is rotating in the forward direction. Upon lapse of a predetermined time after the sensor 85 has been turned on, or immediately after the right end of the sheet P has left the gate 84, the paper-discharging rollers 81 are stopped, then rotated in the reverse direction, as is shown in FIG. 7. The sheet P is thereby fed backward, with its right end passing below the gate 84, as is shown in FIG. 8. The sheet P is eventually guided downwards into the second passage 83 of the paper-reversing section 3 by means of the paper-feeding rollers 83*a* and the paper-feeding rollers 83*b*. The paper sheet P is thereby reversed.

Figure 9:
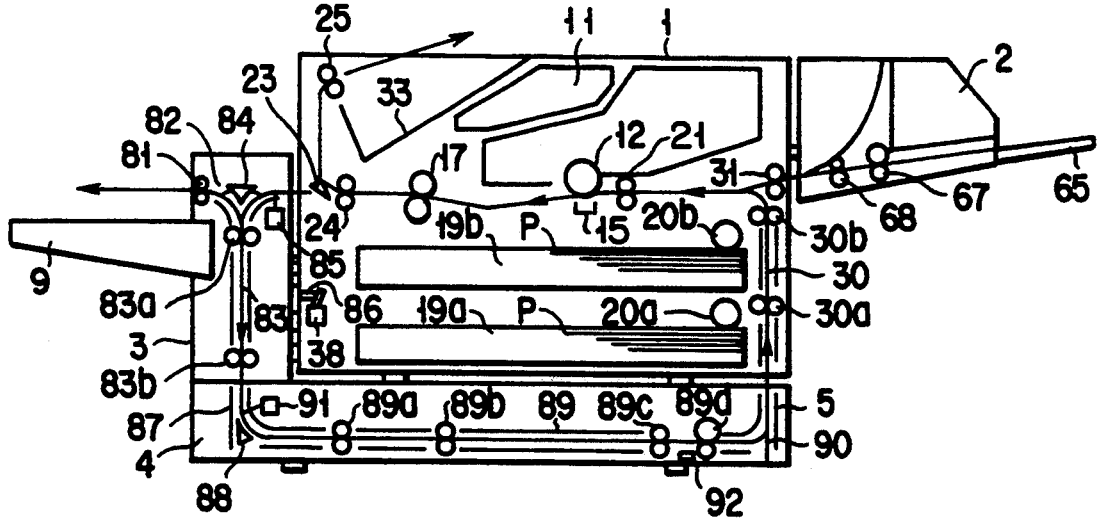
FIG. 9 is another cross-sectional view of the laser printer.
Figure 10:
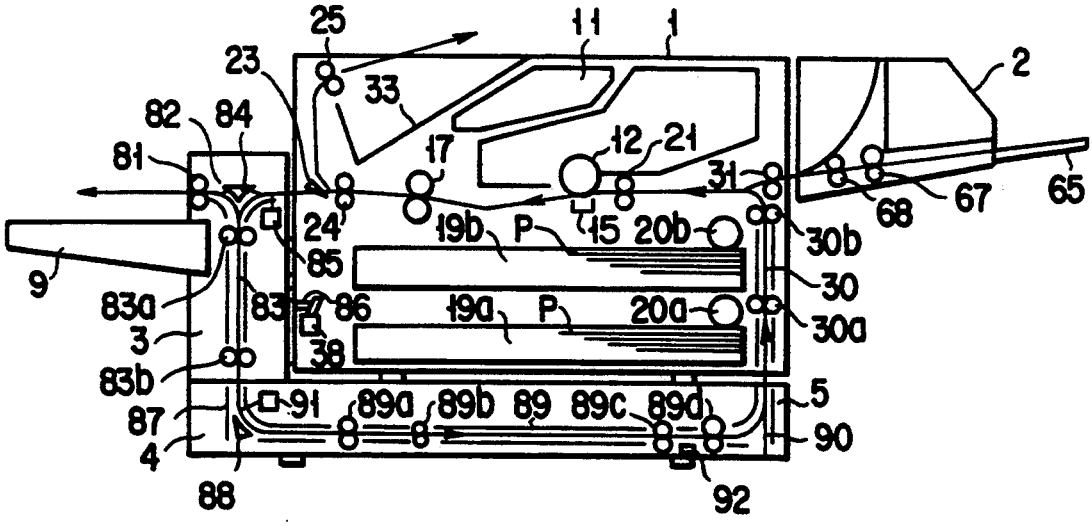
FIG. 10 is also a cross-sectional view of the laser printer shown in FIG. 1.

Once the paper sheet P has been fed into the first passage 87 of the paper-feeding section 4, the sensor 84 is turned on, detecting that the sheet P has just been supplied to the first passage 87. Then, the gate 88 is rotated such that the sheet P is guided into the second passage 89 of the paper-feeding section 4. The sheet P is fed through the second passage 89 toward the aligning rollers 89*d*. The moment the sheet P reaches the sensor 92, this sensor 92 is turned on, driving the aligning rollers 89*d* for a predetermined time. The rollers 89*d* align the paper sheet P, as is shown in FIG. 9. The sheet P, thus aligned, is fed via the second passage 89 into the first passage 30 of the laser printer 1, as is shown in FIG. 10.

The sheet P is supplied to the image transfer device 15. Since the sheet P has been reversed, a toner image is transferred onto the blank side of the paper sheet P. The sheet P is further supplied to the fixing device 17. The device 17 fixes the image on the paper sheet P. The sheet P, now with two images printed on both sides, respectively, is fed into the first paper passage 82 of the paper-reversing section 3. Then, the sensor 85 is turned on, thus detecting that the sheet P in the first paper passage 82. The gate 84 is rotated downward, whereby the sheet P passes over the gate 84. It is eventually discharged onto the paper tray 9 by the discharging rollers 81 rotating in the forward direction.

The large-capacity feeder 6 will now be described, with reference to FIGS. 2 and 11.

As is shown in FIG. 2, the large-capacity feeder 6 comprises a storage section 101 for storing paper sheets P, a paper-feeding section 102 for feeding sheets P from the storage section 101, and a paper-feeding mechanism 103. The storage section 101 has a platform 104 for holding a stack of paper sheets P and a lift mechanism (not shown) for moving the platform 104 upwards.

Figure 11:
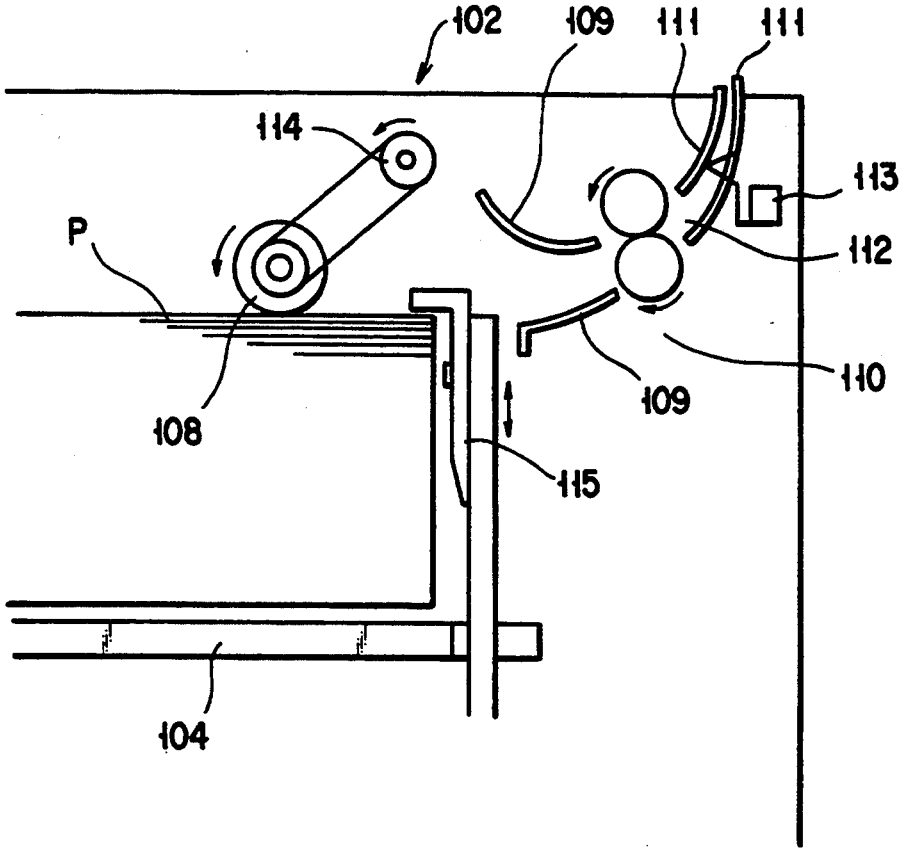
FIG. 11 is a cross-sectional view of the paper-feeding section of the large-capacity paper feeder shown in FIG. 1.

As is best shown in FIG. 11, the storage section 101 is a rectangular box open at the top. A claw 115 is slidably mounted on the inner surface of the right-side wall of the storage section 101. The elevator mechanism always urges the platform, 104 upwards. Hence, the claw 115 contacts the uppermost sheet P of the stack placed on the platform 104, preventing the stack protruding up from the rim of the storage section 101.

As is shown in FIG. 2, the large-capacity feeder 6 further comprises a paper-empty switch 105, a first elevator switch 106, and a second elevator switch 107. The paper-empty switch 105 is located above the storage section 101, for detecting whether or not section 101 is empty. The first elevator switch 106 is also arranged above the storage section 105, for detecting if a predetermined number of sheets P have been fed out of the storage section 101. The second elevator switch 107 is located outside the storage section 101 and at the bottom thereof, for detecting that the platform 104 is at its lowest possible position in the storage section 101.

when the predetermined number of sheets P have been fed from the storage section 101, the first elevator switch 106 is turned on, driving an electric motor (not shown) in the forward direction for a predetermined period of time. This motor drives the elevator mechanism, which in turn lifts the platform 104. When the last paper sheet P is fed from the storage section 101, the paper-empty switch 105 is turned on, driving the electric motor in the reverse direction. As a result, the elevator mechanism lowers the platform 104. The moment the platform reaches its lowest position, the second elevator switch 107 is turned on, stopping the motor, whereby the platform 104 stops at its lowest position in the storage section 101.

As is shown in FIG. 11, the paper-feeding section 102 of the large-capacity feeder 6 comprises a paper-feeding roller 108, two paper guides 109, a pair of aligning rollers 110, two paper guides 111, a sensor 113, and a pulley 114. The pulley is coaxially connected to the paper-feeding roller 108. An endless belt is wrapped around this pulley 114, and the pulley is secured to the shaft of an electric motor (not shown). The paper guides 109, the aligning rollers 110, and the paper guides 111 constitute a paper passage 112 which extends from the right rim of the storage section 101 to the third paper passage 90 of the paper-feeding section 3. When driven by the motor (not shown), the paper-feeding roller 108 feeds the uppermost sheet P from the storage section 101 into the paper passage 112. The sheet P is supplied through the passage 112 as the aligning rollers 110 are rotated in the directions of the arrows shown in FIG. 11. The sensor 113 detects the paper sheet P as the sheet P moves into the third paper passage 90 of the paper-feeding section 3.

As is shown in FIG. 2, the paper-feeding mechanism 103 extends vertically, for feeding paper sheets P downwards from the first passage 87 of the paper-feeding section 4 to either the large-capacity stacker 7 or the sorter 8. The mechanism 103 comprises a paper passage 116 constituted by two pairs of paper-feeding rollers, **116*a* and 116*b*, and a sensor 117 located near the pair of paper-feeding rollers 116*a*. The sensor 117 detects any sheet P supplied into the paper passage from the first passage 87 of the paper-feeding section 4**.

The large-capacity stacker 7 will be described in detail, with reference to FIGS. 1 and 12.

Figure 12:
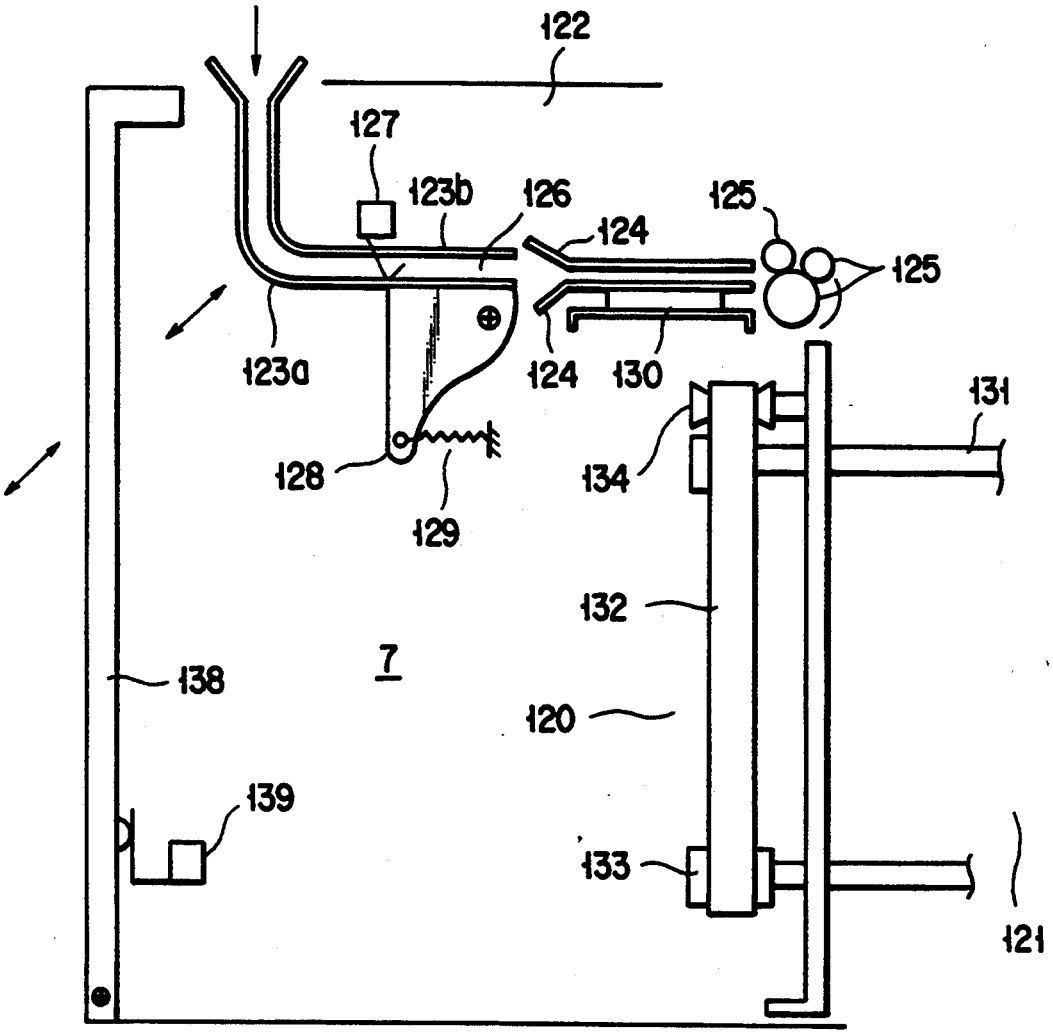
FIG. 12 is a cross-sectional view showing the main components of the large-capacity paper feeder.

As is shown in FIG. 12, the large-capacity stacker 7 comprises an elevator mechanism 120, a storage section 121, and a paper-feeding section 122. The mechanism 120 and the section 122 cooperate to stack paper sheets P in the storage section 121.

In the paper-feeding section 122, a paper sheet P supplied from the large-capacity feeder 6 is fed via a paper passage 126 constituted by two paper guides **123*a* and 123*b*, a pair of paper guides 124, and three paper-discharging rollers 125. The sheet P is discharged into the storage section 121. A sensor 127 is located near the guide 123*b*, for detecting the sheet P which is passing through the paper passage 126**.

A jogger mechanism 130 is provided in the vicinity of the paper guides 124, for sorting paper sheets P passing through the paper passage 126.

The storage section 121 has a platform 131 for supporting paper sheets P discharged out of the paper passage 126. The platform 131 can be moved up and down by the elevator mechanism 120. The mechanism 120 comprises a belt 132 connected to an electric motor (not shown) and can be driven thereby, a takeup roller 133, and an idle roller 134.

As is shown in FIG. 2, a paper-empty switch 135 is located above the storage section 121, for detecting whether or not the section 121 is empty. A first elevator switch 136 is also arranged above the storage section 121, for detecting if a predetermined number of sheets P can be placed on the platform 131. A second elevator switch 137 is located outside the storage section 121 and at the bottom thereof, for detecting when the platform 131 is at its lowest possible position in the storage section 121, or that the storage section 121 is full of paper sheets P.

When the predetermined number of paper sheets P are placed on the platform 131, the first elevator switch 136 is turned on. Then, the motor is driven for a predetermined time or until the first elevator switch 136 is turned off, lowering the platform 131.

The large-capacity stacker 7 has a left-side cover 138 and a side-cover switch 139. The cover 138 can be opened, allowing access to stacker 7. The side-cover switch 139 is located inside the stacker 7 and close to the cover 138. It is operated as the cover 138 is opened and closed, thereby to indicate whether or not the cover 138 is opened or closed.

The sorter 8 will now be described, with reference to FIGS. 3 and 13.

As shown in FIG. 3, the sorter 8 comprises a paper-feeding section 141, a paper-sorting section 142, and a storage section 134.

In the paper-feeding section 141, a paper sheet P supplied from the paper passage 116 of the large-capacity feeder 6 is fed through a paper passage 147. As is shown in FIG. 13, the paper passage 147 is constituted a pair of guides 144, an endless belt 145, and a paper-feeding roller 146. A sensor 148 is arranged near the guides 144, for detecting the feeding of the paper P through the paper passage 147.

The endless belt 145 is wound around two rollers 149 and 150, one of which is rotated by an electric motor (not shown). As a result, the belt 245 is driven in the direction of the arrow shown in FIG. 13.

Figure 13:
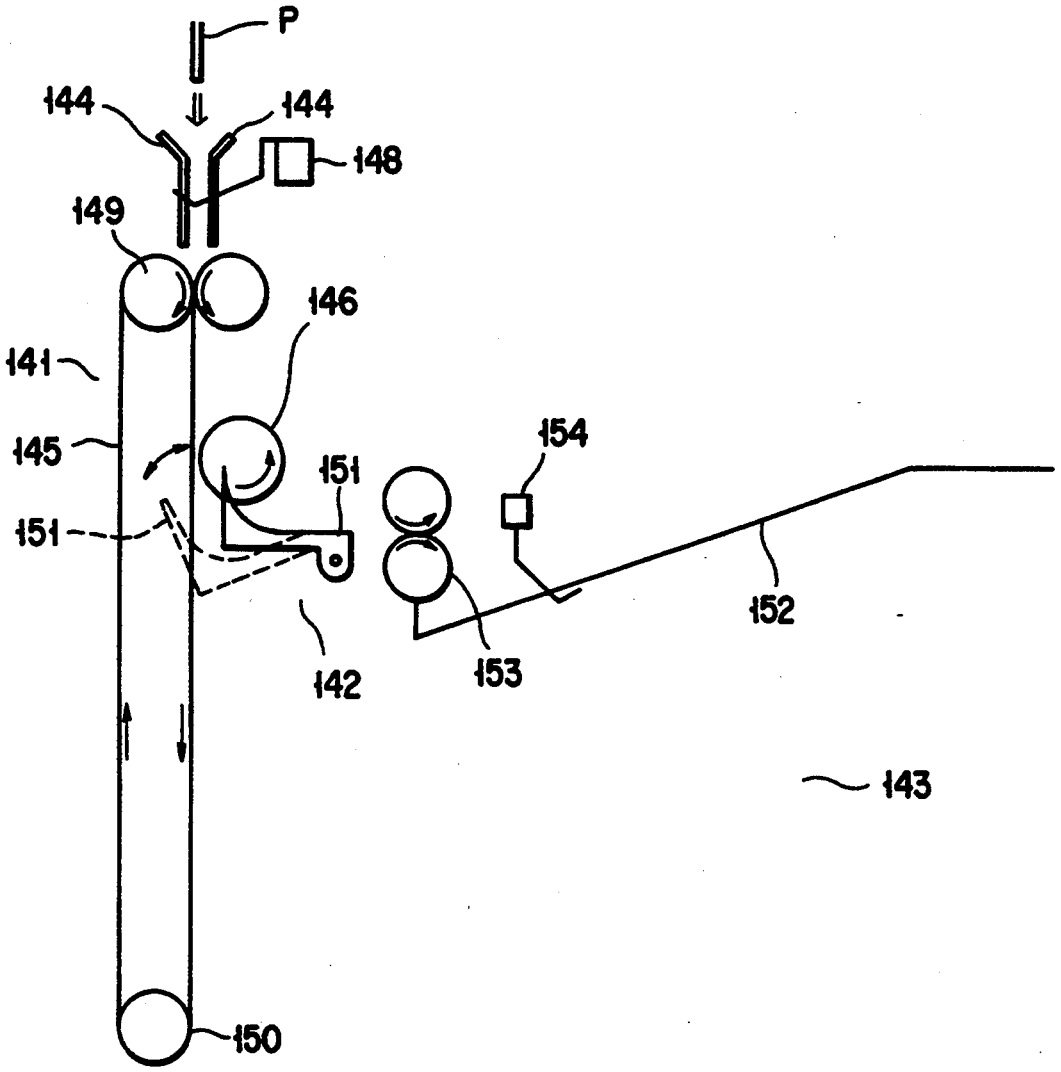
FIG. 13 is a cross-sectional view of the paper sorter shown FIG. 3.

As is shown in FIG. 13, the paper-sorting section 142 has a plurality of gates 151 and pairs of paper-discharging rollers 153. The storage section 143 comprises a plurality of paper tray 152 and a plurality of sensors 154, each located above one paper receptacle 152. Each gate 151 and the pair of rollers 153 located at the exit of the gate 151 form a unit for discharging a paper sheet P onto the associated paper tray 152. Each sensor 154 detects each paper sheet P being placed onto the associated paper tray 152.

Figure 14:
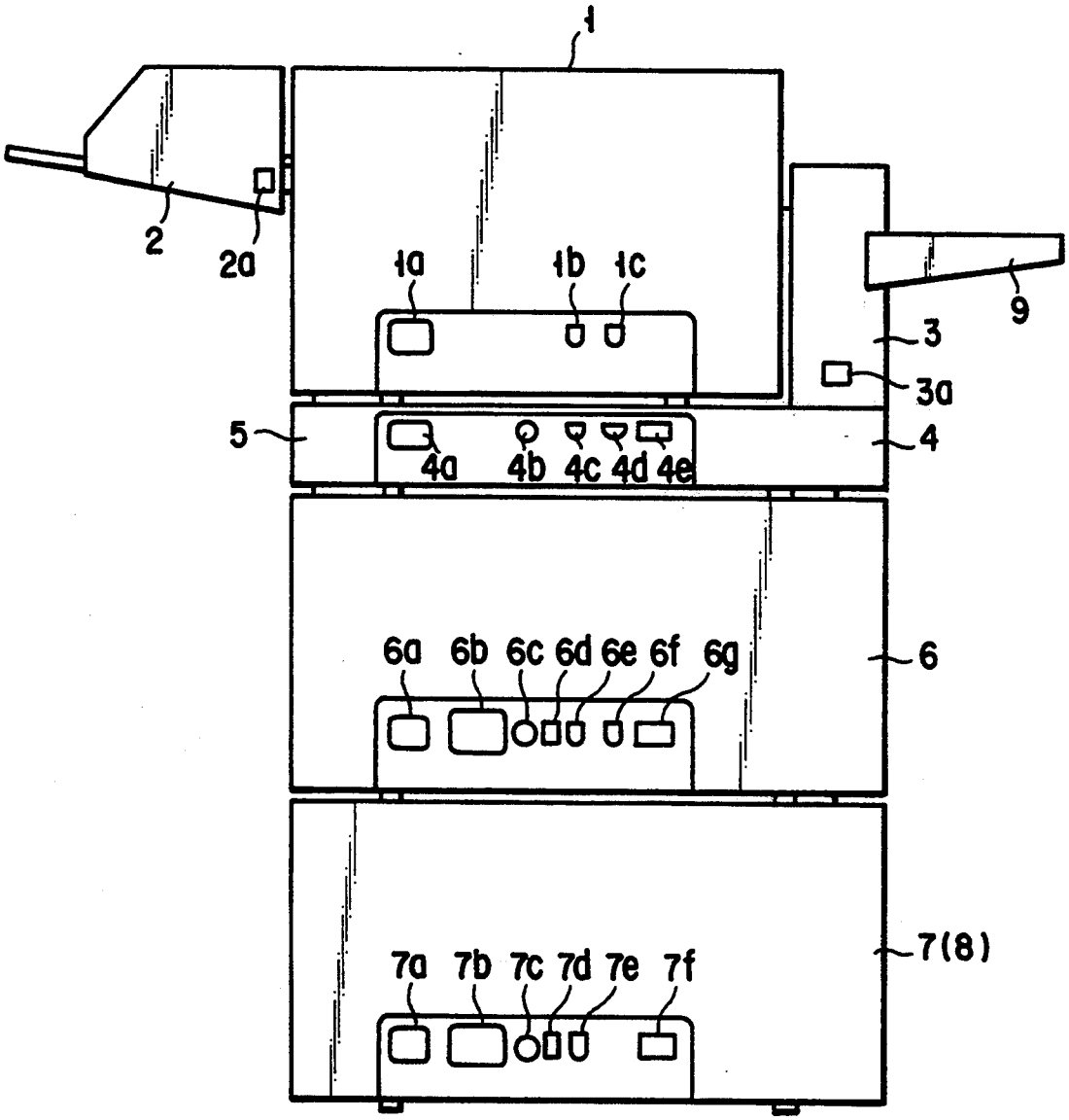
FIG. 14 is a rear view of the image forming system shown in FIG. 2.

FIG. 14 is a rear view of the image forming system shown in FIG. 2. As is evident from this figure, the laser printer 1 has a power inlet **1*a* and two option interface (I/F) connectors 1b and 1c. The printer 1 also has a connector (not shown) for connection with the host computer 10**.

As is shown in FIG. 14, the paper-feeding section 4 has a power inlet 4a, a fuse 4b, two option I/F connectors 4c and 4d. an I/F connector 4e for the paper-reversing section 3. The large-capacity feeder 6 has a power inlet 6a, a power outlet 6b, a fuse 6c, a breaker 6d, two option I/F connectors 6e and 6f, and an I/F connector 6g for the paper-reversing section 3. The large-capacity stacker 7 has a power inlet 7a, a power outlet 7b, a fuse 7c, a breaker 7d, an option I/F connector 7e, and an I/F connector 7f for the paper-reversing section 3.

Like the large-capacity stacker 7, the sorter 8 has, though not shown, a power inlet 8a, a power outlet 8b, a fuse 8c, a breaker 8d, an option I/F connector 8e, and an I/F connector 8f for the paper-reversing section 3.

Figure 15:
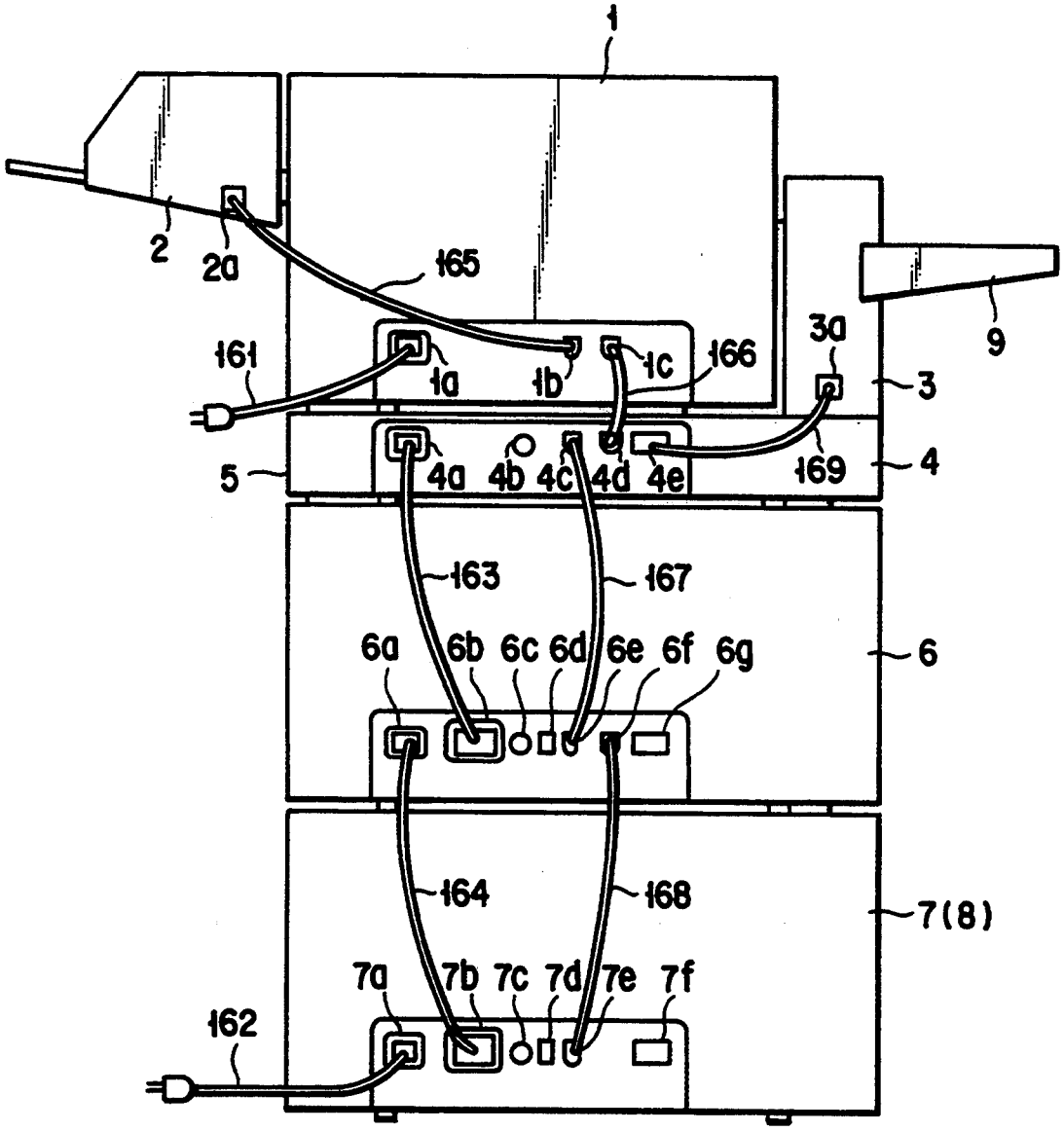
FIG. 15 is a rear view of the image forming system shown in FIG. 2, illustrating the connectors electrically connecting the units constituting the apparatus.

FIG. 15 is a rear view of the image forming system of FIG. 2, illustrating the connectors electrically connecting the units of the system.

As is shown in FIG. 15, the power inlet 1a and the power inlet 7a are connected to an external power outlet by power cables 161 and 162, respectively. The power inlet 4a and power outlet 6b are connected to each other by a power cable 163. The power inlet 6a and the power outlet 7b are connected to each other by a power cable 164.

Figure 16:
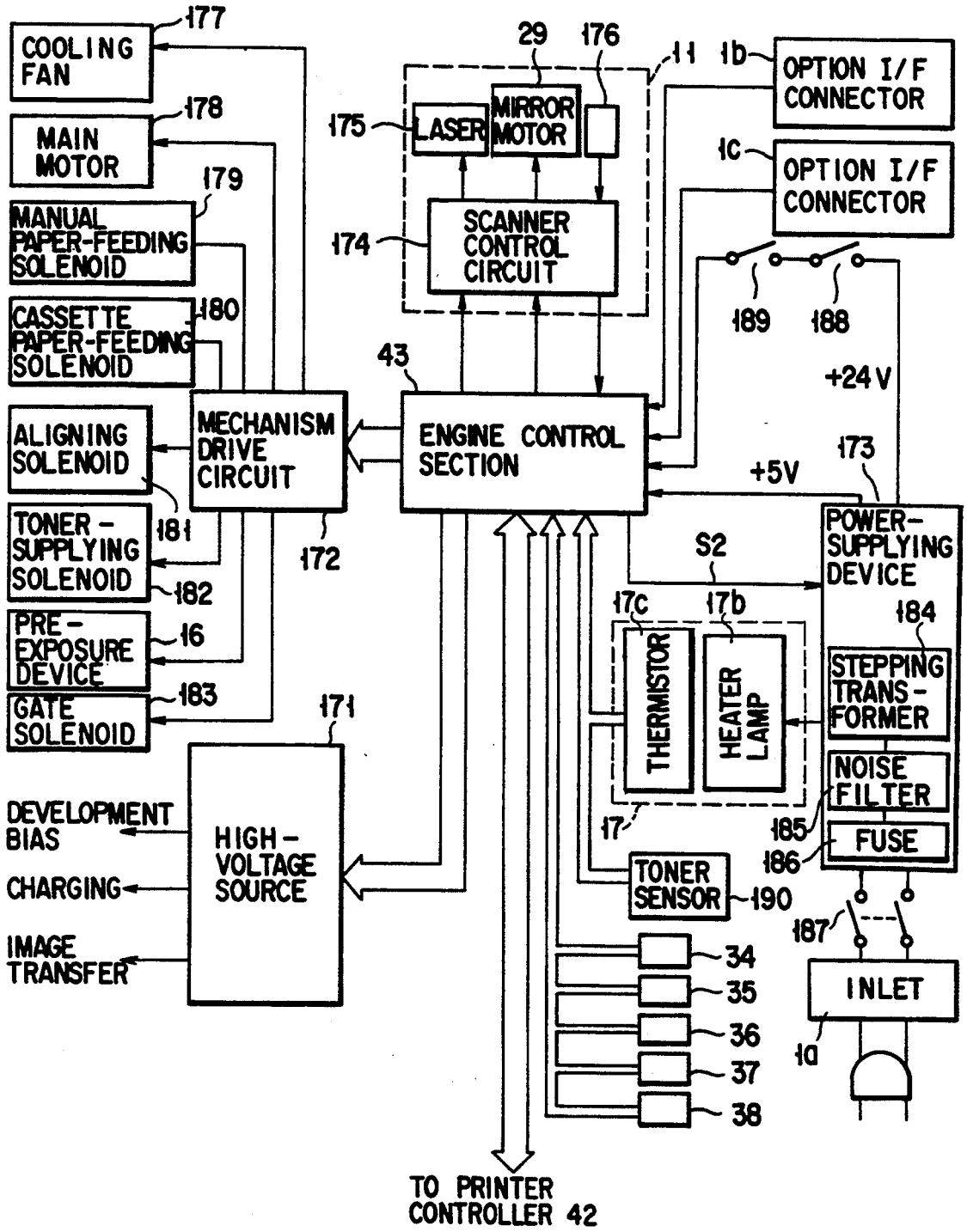
FIG. 16 a block diagram explaining the structure of the laser printer shown in FIG. 1.

As also shown in FIG. 15, the option I/F connector 1 and the I/F connector 2a are connected together by a cable 165. The option I/F connector 1c and the option I/F connector 4b are connected to each other by a cable 166. The option I/F connector 4c and the option I/F connector 6e are connected by a cable 167. The option I/F connector 6f and the option I/F connector 7e are connected by a cable 168. The I/F connector 4e and the I/F connector 3a are connected together by a cable 169.

with reference to FIG. 16, the control circuit incorporated in the laser printer 1 will now be described.

As has been described, the housing of the laser printer 1 contains the engine control section 43 which controls the electric components of the printer 1, to accomplish an electrophotographic process. Connected to the engine control section 43 are: the laser optical system 11, the pre-exposure device 16, the fixing device 17, the sensors 34, 35, 36, the switch 37 for detecting the connection of the feeder 2 to the printer 1, the switch 38 for detecting the connection of the section 3 to the printer 1, the option I/F connectors 1b and 1c, a high voltage source 171, a mechanism drive circuit 172, and a power-supplying device 173.

The high-voltage source 171 supplies a development bias signal to a development-bias supplying section (not shown), a charging signal to the electric charger 13, and an image-transfer signal to the wire high-voltage supplying section (not shown) of the image transfer device 15, each signal being of a high voltage.

The mechanism drive circuit 172 is designed to drive motors and solenoids. Connected to this circuit 172 are: a cooling fan 177, a main motor 178, a manual paper-feeding solenoid 179, a cassette paper-feeding solenoid 180, an aligning solenoid 181, a toner-supplying solenoid 182, and a gate solenoid 183.

When the manual paper-feeding solenoid 179 is excited, the rotation of the main motor 178 is transmitted to the pair of paper-feeding rollers 31. When the cassette paper-feeding solenoid 180 is excited, the rotation of the main motor 178 is transmitted to either the paper-feeding roller 20aor the paper-feeding roller 20b. When the aligning solenoid 181 is excited, the rotation of the main motor 178 is transmitted to the pair of aligning rollers 21. When the toner-supplying solenoid 182 is excited, the rotation of the main motor 178 is transmitted to the toner-supplying roller (not shown) incorporated in the developing device 14. When the gate solenoid 183 is excited, the gate 23 is turned.

As can be understood from the above, the present invention can provide an image forming apparatus which occupies but a relatively small area, even if provided with optional devices.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus comprising:

a first unit having a bottom with a first inlet port, a side with a first outlet port, image forming means for forming a visible image from image data externally supplied, image transfer means for transferring the visible image from said image forming means onto a transfer material, internal storage means for storing the transfer material, external storage means for storing the transfer material, first conveyer means connected to said first inlet port, for conveying the transfer material from said internal or external storage means to said image transfer means, and discharging means connected to said first outlet port, for discharging the transfer material bearing the visible image, outside said first unit;

a second unit detachably connected to the side of said first unit and having a second inlet port communicating with said first outlet port, reversing means for selectively reversing the transfer material, a bottom with a second outlet port through which to discharge the transfer material, and second conveyer means for conveying the transfer material from said second inlet port to said second outlet port;

a third unit having located beneath said first and second units and having a top having a third inlet port communicating with said second outlet port and having a third outlet port communicating with said first inlet port, third conveyer means extending between said third inlet port and said third outlet port for conveying the transfer material therebetween, and a bottom having a fourth outlet port and a fourth inlet port provided in correspondence with said third inlet port and third outlet port, respectively;

a fourth unit located beneath said third unit and having a fifth outlet port communicating with said fourth inlet port, large-capacity storage means for storing the transfer material to be conveyed to said fifth outlet port, a fifth inlet port communicating with said fourth outlet port, a bottom with a sixth outlet port, and a fourth conveyor means extending between said fifth inlet port and said sixth outlet port for conveying the transfer material therebetween; and a fifth unit having a sixth inlet port communicating with said sixth outlet port, and means connected to said sixth inlet port, for storing the transfer material conveyed from said sixth inlet port, wherein a total bottom area of said first and second units is substantially equal to each of a top area and bottom area of the third, fourth and fifth units.

2. The image forming apparatus according to claim 1, wherein each of said first, third, and fourth units has positioning members on the bottom.

3. The image forming apparatus according to claim 1, wherein each of said first to fifth units has a power inlet and a power outlet which are connected to an external power supply by power cables.

4. An image forming apparatus comprising:

a first unit having a bottom with a first inlet port, a side with a first outlet port, image forming means for forming a visible image from image data externally supplied, image transfer means for transferring the visible image from said image forming means onto a transfer material, first conveyer means for conveying the transfer material to said image transfer means, and discharging means connected to said first outlet port, for discharging the transfer material bearing the visible image, outside said first unit;

a second unit detachably connected to the side of said first unit and having a second inlet port communicating with said first outlet port, reversing means for selectively reversing the transfer material, a bottom with a second outlet port through which to discharge the transfer material, and second conveyer means for conveying the transfer material from said second inlet port to said second outlet port;

a third unit located beneath said first and second units and having a top having a third inlet port communicating with said second outlet port and having a third outlet port communicating with said first inlet port, third conveyer means extending between said third inlet port and said third outlet port for conveying the transfer material therebetween, and a bottom having a fourth outlet port and a fourth inlet port provided in correspondence with said third inlet port and third outlet port, respectively; and a fourth unit located beneath said third unit and having a fifth outlet port communicating with said fourth inlet port and large-capacity storage means for storing the transfer material to be conveyed to said fifth outlet port, wherein a total bottom area of said first and second units is substantially equal to each of a top area and bottom area of said third unit and is substantially equal to each of a top area and bottom area of said fourth unit, and wherein said second outlet port and said third inlet port are aligned with each other through said second and third units, and said first inlet port, third outlet port, fourth inlet port and fifth outlet port are aligned with each other through said first, third and fourth units.

5. The image forming apparatus according to claim 4, wherein each of said first, third, and fourth units has positioning members on the bottom.

6. The image forming apparatus according to claim 4, wherein each of said first to fourth units has a power inlet and a power outlet which are connected to an external power supply by power cables.

7. The image forming apparatus according to claim 4, further comprising a fifth unit having a fifth inlet port communicating with said fourth outlet port, and means, communicating with the fifth inlet port, for sorting or stacking the transfer material.

8. An image forming apparatus comprising:

a first unit having a bottom with a first inlet port, a side with a first outlet port, image forming means for forming a visible image from image data externally supplied, image transfer means for transferring the visible image from said image forming means onto a transfer material, first conveyer means for conveying the transfer material to said image transfer means, and discharging means connected to said first outlet port, for discharging the transfer material bearing the visible image, outside said first unit;

a second unit detachably connected to the side of said first unit and having a second inlet port communicating with said first outlet port, reversing means for selectively reversing the transfer material, a bottom with a second outlet port through which to discharge the transfer material, and second conveyer means for conveying the transfer material from said second inlet port to said second outlet port;

a third unit located beneath said first and second units and having a top having a third inlet port communicating with said second outlet port and having a third outlet port communicating with said first inlet port, third conveyer means extending between said third inlet port and said third outlet port for conveying the transfer material therebetween, and a bottom having a fourth outlet port provided in correspondence with said third inlet port; and a fourth unit having a fourth inlet port communicating with said fourth outlet port, and means connected to said fourth inlet port for storing the transfer material conveyed from said fourth inlet port;

wherein a total bottom area of said first and second units is substantially equal to each of a top area and bottom area of said third and fourth units, and wherein said second outlet port, third inlet port, fourth outlet port and fourth inlet port are aligned with each other through said second, third and fourth units.

9. The image forming apparatus according to claim 8, wherein each of said first, third and fourth units has positioning members on the bottom.

10. The image forming apparatus according to claim 9, wherein each of said first to fourth units has a power inlet and a power outlet which are connected to an external power supply by power cables.

11. The image forming apparatus according to claim 1, wherein the storing means provided in said fifth unit includes a large capacity stacker for storing a large number of transfer materials.

12. The image forming apparatus according to claim 1, wherein the storing means provided in said fifth unit includes a mail box stacker having a plurality of receptacles for selectively receiving the transfer material.

13. The image forming apparatus according to claim 4, wherein said storage means includes a large capacity stacker for storing the transfer material.

14. The image forming apparatus according to claim 4, wherein said storage means includes a mail box stacker having a plurality of paper receptacles for selectively receiving the transfer material.

15. The image forming apparatus according to claim 1, wherein said second outlet port, third inlet port, fourth outlet port, fifth inlet port, sixth outlet port and sixth inlet port are aligned with each other through said second, third, fourth and fifth units, and said first inlet port, third outlet port, fourth inlet port and fifth outlet port are aligned with each other through said first, third and fourth units.

* * * * *